US005231411A

United States Patent [19]

Harrington et al.

[11] Patent Number: 5,231,411

[45] Date of Patent: Jul. 27, 1993

[54] ONE PIECE MILLIMETER WAVE PHASE SHIFTER/ANTENNA

[75] Inventors: William A. Harrington, Whittier; James V. Strahan, Brea; Lawrence DiFrancesco, Hayward, all of Calif.

[73] Assignee: Hughes Aircraft Company, Los Angeles, Calif.

[21] Appl. No.: 708,953

[22] Filed: May 31, 1991

[51] Int. Cl.[5] ..... H01Q 13/10

[52] U.S. Cl. ..... 343/771; 343/787; 343/770

[58] Field of Search ..... 343/771, 787, 770, 767, 343/768, 785

[56] References Cited

U.S. PATENT DOCUMENTS

| | | | |
|---|---|---|---|
| 3,377,592 | 4/1968 | Robieux et al. | 343/787 |
| 3,491,363 | 1/1970 | Young, Jr. | 343/771 |
| 3,855,597 | 12/1974 | Garlise | 343/787 |
| 4,613,869 | 9/1986 | Ajioka et al. | 343/768 |

FOREIGN PATENT DOCUMENTS

| | | | |
|---|---|---|---|
| 613314 | 1/1961 | Canada | 343/771 |

*Primary Examiner*—Rolf Hille
*Assistant Examiner*—Hoanganh Le
*Attorney, Agent, or Firm*—Wanda K. Denson-Low

[57] ABSTRACT

A one piece millimeter wave phase shifter/antenna, wherein magnetic flux is imported into a ferrite rod body through a plated metallic film helix, driven by a pulse generator to change the amount of remnant flux, and therefore the relative microwave phase shift from one aperture port to its neighbor.

6 Claims, 1 Drawing Sheet

ONE PIECE MILLIMETER WAVE PHASE SHIFTER/ANTENNA

BACKGROUND OF THE INVENTION

The present invention relates to the field of antennas, and more particularly to millimeter wave phase shifters and antennas.

Millimeter wave RF components are characterized by their relatively small size due to the shortness of the wavelength. An existing millimeter wave combined phase shifter/antenna array is described in U.S. Pat. No. 4,613,869, by James S. Ajioka and James V. Strahan and assigned to a common assignee with the present application. The entire contents of U.S. Pat. No. 4,613,869 is incorporated herein by this reference. In the antenna of this patent, magnetic flux is imparted into the ferrite rod body through a pair of similar ferrite yokes that provided a return path for the magnetic field. Around these yokes are a pair of drive coils of wire, which are driven by a pulse generator, changing the amount of remnant flux, and therefore the relative microwave phase shift from one aperture port to its neighbor. This allows the exiting beam to be directed, achieving a scanning motion.

The present invention is an improvement to the combined phase shifter/antenna array of U.S. Pat. No. 4,613,869, in order to eliminate a number of components, instead performing their tasks within a single processed and plated ferrite rod.

It is therefore an object of the present invention to provide an improved millimeter wave phase shifter/antenna which employs fewer components, is less expensive to fabricate, and is rugged in operation.

SUMMARY OF THE INVENTION

In accordance with the invention, an improved millimeter wave phase shifter/antenna is provided, wherein the ferrite yokes and drive coils of the device described in U.S. Pat. No. 4,613,869 are replaced with a plated metallic film helix, bonded to the surface of the phase shifter ferrite rod. Thus, an antenna in accordance with the present invention includes a ferrite rod, on which is formed a first layer of electrically conductive material. A plurality of apertures are formed in the first conductive layer, wherein RF energy exiting the apertures forms a beam of energy. A first dielectric layer is formed over the first conductive layer.

In accordance with the invention, a second layer of electrically conductive material is formed over the first dielectric layer which has no masking of the apertures formed in the first layer to define a helically shaped conductive region from a first end of the rod to a second end. The helix may be defined, e.g., by cutting a helical groove through the second layer of electrically conductive material. This cutting also removes the conductive material from the zones surrounding the apertures. A current drive source is connected to the ends of the helical shaped conductive region. The beam defined by electromagnetic energy radiated through the apertures may be scanned spatially by adjusting the current driven through the helical shaped conductive region.

The invention further includes a method for making a millimeter wave phase shifter/antenna, comprising a sequence of the following steps:

coating a ferrite rod with a first layer of electrically conductive material, thereby forming a waveguide;

forming a plurality of apertures in the first conductive layer;

forming a first dielectric layer over the first conductive layer;

forming a second layer of electrically conductive material over the first dielectric layer to define a helical shaped conductive region from a first end region of the rod to a second end region without obscuring the apertures; and connecting a current drive source to each of the first and second end regions.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
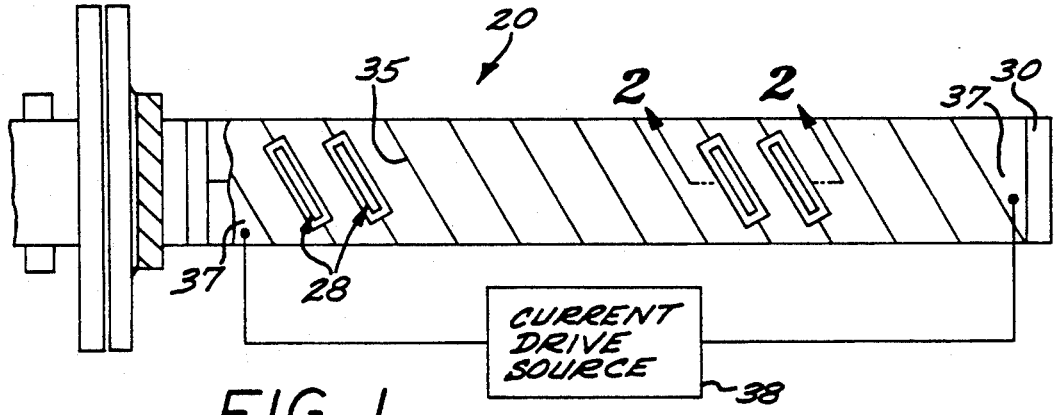
FIG. 1 is a partial side view of a millimeter wave phase shifter/antenna embodying the present invention.
Figure 2:
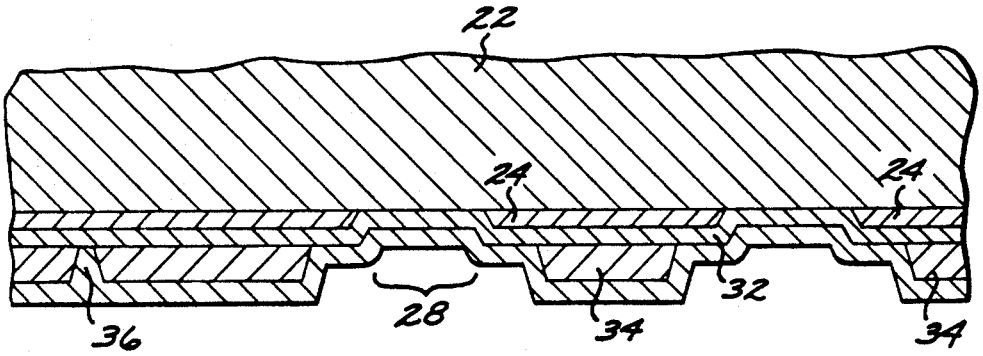
FIG. 2 is an enlarged view illustrative of the area within phantom circle 2 of FIG. 1, showing the construction of the device in further detail.

FIGS. 1 and 2 illustrate a millimeter wave phase shifter/antenna 20 embodying the present invention. The device 20 comprises a ferrite rod 22 on which a first electrically conductive plated layer 24 has been formed. Preferably, the rod 22 has a square or circular cross-sectional configuration, although other configurations may be suitable for particular applications. The plating could be of any number of possible metals, e.g., silver, for its superior electrical and thermal properties. This plating layer 24 causes the rod 22 to act like a waveguide, containing any RF energy imparted into one end, at the RF input flange 26, down through the ferrite with minimal loss and to the other end, at which an RF load 30 is connected. Into this plating layer 24 are cut or formed angled slots 28, their dimension and angle dependent on the desired polarization and frequency of the output beam of RF energy, as more fully described in U.S. Pat. No. 4,613,869. The apertures may be formed in the conductive layer 24 by etching or by laser cutting, for example. The relative spacing of the slots 28 versus the selected frequency determines the shape of the formed beam caused by RF energy as it leaks out each of the apertures 28.

The first metal film layer 24, as well as the next successive one 34, are formed by drawing, painting or dipping the rod 22 into a metallo-organic solution. The consistency of this solution determines the thickness of the metallization, typically on the order of 1 to 5 microns. The coated rod 22 is then baked to fire the metal into place, as well as to drive out the carrier solution. The film layer 24 could also be sputtered onto the rod.

Next, the apertures 28 are cut into the metallization using a high power laser in this example, enabling high accuracy and tight control of penetration depth. In an exemplary 60 GHz application, the apertures 28 may have a width of 0.005 inches and a length of 0.015 inches. After this step is satisfactorily completed, and has been optionally tested, the plated rod 22 is then dipped or sprayed with the next coating layer 32, an oxide such as silicon dioxide or other suitable dielectric.

The layer 32 forms a passivation layer, in addition to providing electrical insulation between the waveguide metallization layer 24 and the next helix layer 34. This coating 32 is baked into place, as was the first layer 24.

On top of this layer 32 comes another, thicker, layer 34 of the metallo-organic solution. This layer is thicker than the layer 24, in a typical application on the order of 10 to 30 microns or higher, since it will carry high currents. It too is baked to form a second metal conductive layer 34. It may be possible to combine some of the foregoing steps, but in the preferred embodiment these steps are performed as separate operations.

Into this last layer 34 a groove 35 is cut with the laser, as the rod 22 is rotated in an automated turning fixture. The width of the groove 35 is minimal, except in the areas where the apertures 28 lie. Here the laser is scanned to remove all metallization in close proximity of the aperture 28, so that no interaction exists between the last layer 34 of metallization and the exiting RF beam. The underlying metallization layer 24 forming the waveguide is protected by the dielectric layer 32 as the helix is cut, a common process often used in thick film circuit construction.

While the apertures 28 are shown in the exemplary embodiment as aligned with the helical groove 35, in many applications it will be found to improve performance to dispose the apertures at an angle with respect to the groove 35; one particularly advantageous orientation for some applications is 45 degrees.

Large areas of undisturbed metallization are left at each end of the completed rod assembly, to facilitate electrical connection of the phase shifter drive helix to the current drive circuit 38. The number of effective turns of the drive helix comprising the conductive layer 34 determines the sensitivity of the phase shifter portion of the assembly to current drive impulses. These connection areas 37 are masked during the final coating step, wherein a last protective coating layer 36, e.g., of glass, magnesium fluoride or an organic material, is either baked, or air cured in place. RF connection is made to the two ends, by the RF coupling 26 and the RF load 30, making a tight, nearly seamless connection to the first metallization layer 24, but not touching the helix layer 34.

A feed waveguide 10 with its corresponding RF flange 12 is connected at the flange 26 to the waveguide formed by the plated rod. A circular polarizer 16 is disposed preceding the phase shifter portion of the antenna 20. Circular polarizers are well known in the art, and may comprise, e.g., four magnets. Other known circular polarizers employ orthopolarization mode transducers with quarterwave plates, a quadrature hybrid feeding the orthogonal ports of an orthopolarization mode transducer, and the like.

In operation, the particular direction of the beam of the antenna 20 exiting from the apertures 28 will be determined by the current drive on the helix. In general, the current drive source 38 will provide a continuous drive current through the helix for a given beam direction. In order to change the beam direction, the current drive will be changed to vary the magnetic field which is applied to the ferrite by the helical coil defined by the layer 34.

Figure 3:
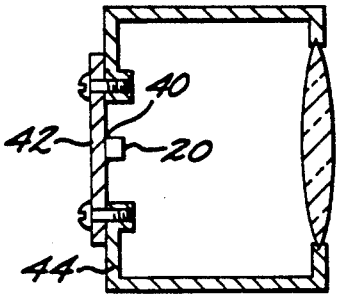
FIG. 3 is a cross-sectional view of an antenna assembly embodying the invention.

Referring now to FIG. 3, an exemplary system employing the antenna 20 is shown in simplified form. The assembly 20 can be elastically bonded by bonding material 40 to a backing plate 42, it being fastened to the rear of the reflector/lens enclosure 44, that also serves to protect the rod assembly 30 from damage and environmental degradation. The plate 42 also serves as a ground plane. The reflector/lens 44 served the function of beam focussing and collimation.

In an exemplary application operating at 60 GHz, the phase shifter/antenna of U.S. Pat. No. 4,613,869 would utilize a square rod 0.050 inch on a side, by 8.00 inches ratio. This would entail an extremely fragile assembly, expensive to manufacture, and presenting a potential reliability problem, especially when used in an automotive environment. By eliminating the two yokes in accordance with the invention, the parts count of the phase shifter/antenna is reduced three-to-one. Instead of dealing with the mechanical difficulty of bonding three fragile elements into one magnetically tightly coupled unit, care can be concentrated on the one single remaining unit, operating in a stand alone mode. Thus, the phase shifter/antenna of the present invention can be fabricated at a significantly reduced cost, in comparison to the device of U.S. Pat. No. 4,613,869, is easy to assemble, and provides greatly increased reliability.

The device of the present invention has a lower performance in a couple of areas than that of the device of U.S. Pat. No. 4,613,869, but these have no effect on applications such as in automotive collision avoidance radar. The use of the plated helix will reduce the maximum switching rate of the phase shifter when compared to the conventional design employing drive yokes. The field generated by the helix cannot penetrate the ferrite rod as quickly as that generated by a pair of yokes. Since the scan rate of an automotive radar is relatively slow, this has a negligible effect. The other difference deals with the performance of the ferrite when operating in a latching mode. The lack of yokes eliminate this mode, but this is not the preferred mode of operation of the device in accordance with the invention.

In the discussions herein, the invention is generally referred to as being usable for radiating. However, it is to be understood that the invention is capable of both radiation and reception, and for convenience of description only, the invention and elements of it are referred to in terms of their functions in the radiation of electromagnetic energy.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An antenna array for spatially scanning a beam of electromagnetic energy, comprising:

a ferrite rod;

a first layer of electrically conductive material formed on said ferrite rod to thereby define a waveguide;

a plurality of apertures formed in said conductive layer exposing portions of said ferrite rod;

a first dielectric layer formed over said first conductive layer and covering said apertures;

a second layer of electrically conductive material formed on said first dielectric layer wherein said second layer is patterned to define a helically-shaped conductive region wound about said dielectric-coated waveguide from a first and region of said dielectric-coated waveguide to a second end region without covering said dielectric-coated apertures; and a current drive source connected to each end of said helically-shaped conductive region, whereby a beam defined by electromagnetic energy radiated or received through said apertures is scanned in the spatial domain by changes int eh magnetic domains of the ferrite rod, the scanning being affected by the current driven through said helical shaped conductive region.

2. The antenna of claim 1 further comprising a passivation layer formed over said second layer of electrically conductive material.

3. The antenna of claim 1 wherein a helical groove is cut in said second layer of electrically conductive material to define said helical shaped conductive region.

4. The antenna of claim 1 further comprising polarizing means for circularly polarizing electromagnetic energy which traverses said rod.

5. The antenna of claim 1 further characterized in that electromagnetic energy is fed into said waveguide from a feed end thereof, and by an RF load coupled to the opposite end of the waveguide from the feed ned.

6. The antenna of claim 5 further characterized by an RF coupling flange connected to said feed end of said waveguide.

* * * * *